US005954456A

United States Patent [19]

Bowles

[11] Patent Number: 5,954,456

[45] Date of Patent: Sep. 21, 1999

[54] TORQUE NUT FOR MINE ROOF BOLT ASSEMBLY

[76] Inventor: David A. Bowles, 2370 Anton Rd., Madisonville, Ky. 42431

[21] Appl. No.: 08/882,144

[22] Filed: Jun. 25, 1997

[51] Int. Cl.[6] ..... E21D 20/00; F16B 39/22; B21D 53/24

[52] U.S. Cl. ..... 405/259.6; 405/259.5; 405/302.1; 411/285; 470/19

[58] Field of Search ..... 405/259.6, 259.2; 411/285, 286, 287; 470/19

[56] References Cited

U.S. PATENT DOCUMENTS

| | | | |
|---|---|---|---|
| 609,144 | 8/1898 | Goddin . | |
| 991,016 | 5/1911 | Pearson . | |
| 2,007,310 | 7/1935 | Sharp | 470/19 |
| 2,054,393 | 9/1936 | Sharp | 470/19 |
| 2,330,511 | 9/1943 | Money | 470/19 |
| 2,688,355 | 9/1954 | Forster | 470/19 |
| 3,208,494 | 9/1965 | Skidmore | 411/287 X |
| 3,352,342 | 11/1967 | Jacobson | 411/285 X |
| 3,441,073 | 4/1969 | Johnson | 411/287 X |
| 3,877,235 | 4/1975 | Hill . | |
| 3,940,941 | 3/1976 | Libert et al. . | |
| 3,971,085 | 7/1976 | Mount | 407/19 |
| 3,979,918 | 9/1976 | Vidler | 405/259.2 X |
| 4,132,080 | 1/1979 | Hansen . | |
| 4,275,975 | 6/1981 | Morgan . | |
| 4,303,354 | 12/1981 | McDowell, Jr. . | |
| 4,607,984 | 8/1986 | Cassidy | 405/259.6 |
| 4,662,795 | 5/1987 | Clark et al. | 405/259.6 |
| 4,784,531 | 11/1988 | Calandra | 405/259.6 X |
| 5,282,698 | 2/1994 | Wright et al. | 405/259.6 |
| 5,352,065 | 10/1994 | Arnall et al. . | |
| 5,417,520 | 5/1995 | Rastall . | |

FOREIGN PATENT DOCUMENTS

| | | | |
|---|---|---|---|
| 1520975 | 4/1968 | France | 411/285 |
| 0255308 | 7/1926 | United Kingdom | 411/285 |

*Primary Examiner*—Dennis L. Taylor
*Attorney, Agent, or Firm*—Bacon & Thomas, PLLC

[57] ABSTRACT

A torque nut for a mine roof or rock bolt intended for use with a multi-component, rapid curing resin that is mixed by rotation of the bolt through the torque nut includes a nut body having a threaded bore including threads of uniform lead and threads of progressively decreasing lead whereby the threads of decreasing lead create an interference between the nut threads and the bolt threads when the nut is threaded on the bolt to permit transmittal of a predetermined torque through the nut into the bolt to mix the resin in a bore hole associated with the bolt. The threads of decreasing lead in the torque nut are created by a coining process that does not affect the geometry of the threads other than the thread leads, which are affected in a progressive manner as the distance from the coined end of the nut increases. The interference between the nut threads and the bolt threads is not so great as to prevent advancement of the nut along the bolt after the resin has cured to permit tensioning of the bolt through continued advancement of the nut up to its final installed position.

12 Claims, 3 Drawing Sheets

FIG. 4
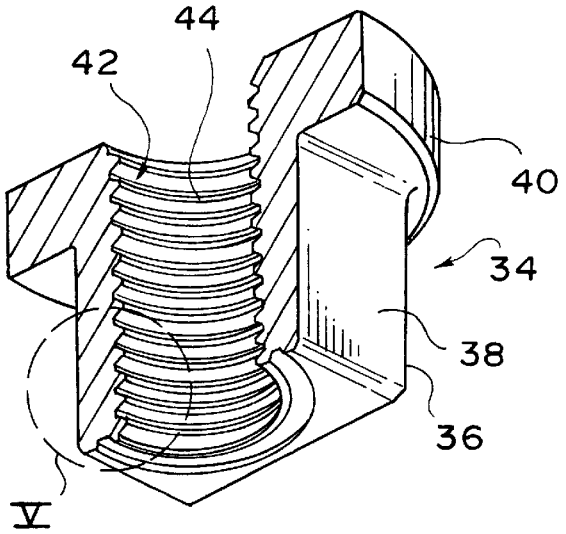
FIG. 6
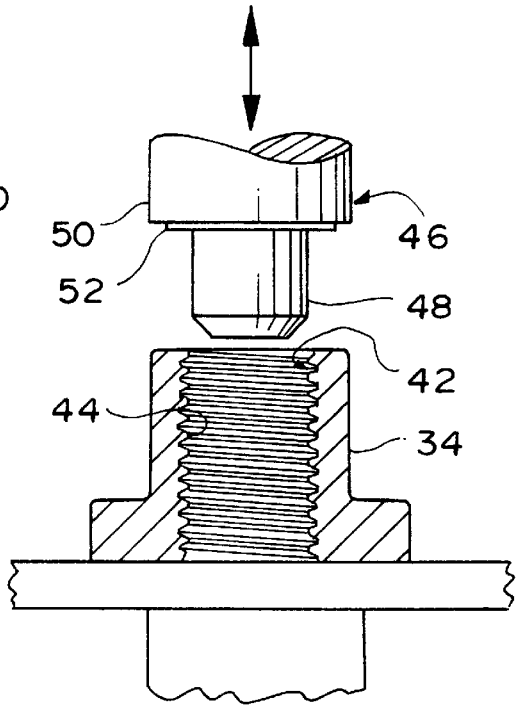
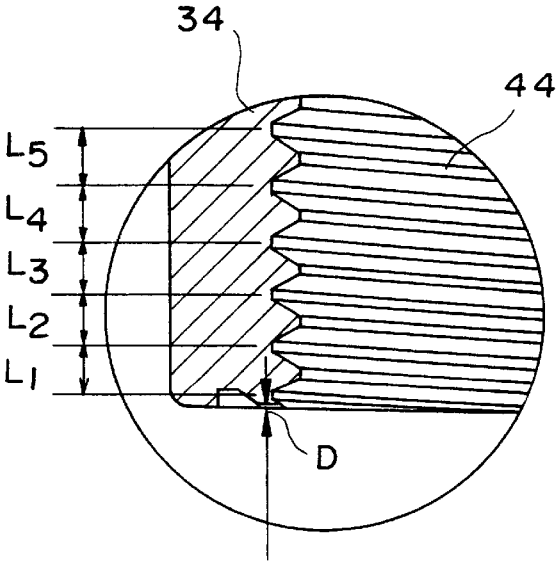
FIG. 5

TORQUE NUT FOR MINE ROOF BOLT ASSEMBLY

BACKGROUND OF THE INVENTION

1. Field of the Invention

This invention relates to a torque nut for a mine roof bolt assembly in which the bolt is to be rotated through the nut after installation of the bolt in a mine roof bore hole using a mine bolt resin system to cause mixing of the resin.

2. Discussion of Related Technology

Mine roof bolt systems (such term being inclusive of rock bolt systems) are commonly set into a bore hole drilled into rock strata defining a mine roof using a mine bolt resin system that utilizes multi-components mixed in situ by rotation of the mine bolt after installation of the resin and bolt in the bore hole to thereby cause the resin to span the gap between the bolt and the mine roof bore hole and to retain the bolt firmly in the bore hole.

It is also common practice to transmit resin mixing torque to the mine roof bolt through a nut element to cause mixing of the resin system after the bolt has been inserted into the bore hole and to fracture the capsules or cartridges of the resin to cause the resin to flow into the area between the mine roof bolt and the surrounding walls of the bore hole in the mine roof.

The nut element used to rotate the bolt is the same nut element used to tension the bolt after the resin has cured and hardened so that it is important to control the degree of torque transmitted through the nut into the bolt along the nut and bolt threads so that, after the bolt has been set in the resin and the resin has hardened, the nut can be advanced along the bolt without excessive difficulty.

Power tools or pinners are typically used to drive the mine roof bolts into the bore holes placed in the rock of the mine roof and the pinners are also driven in rotation to apply torque to the nut elements associated with the mine roof bolts to thereby mix the resin previously inserted in the bore hole through the rotation of the mine bolt, followed by advancement of the nut along the mine roof bolt (after the resin has hardened) to tension the bolt in its bore hole while producing a thrust against a pressure plate or other element located between the nut and the mine roof.

Typical prior art examples are described in U.S. Pat. No. 4,662,795 granted to Clark et al. on May 5, 1987; and U.S. Pat. No. 5,352,065 granted to Arnall et al. on Oct. 4, 1994. In each of these examples, a torque nut applied to the mine roof bolt has a deformable or frangible portion that permits transmittal of a predetermined torque through the nut into the bolt to rotate the bolt and to cause mixing of the resin system that has been previously placed in the bore hole to secure the bolt in the mine roof before the nut is fully advanced along the bolt. The deformable and frangible sections of the torque nuts, however, tend to interfere with the power tools used to rotate the nuts and find their way into the pinners or the mine machinery used to drive the pinners.

Other torque nut arrangements are described in U.S. Pat. No. 5,417,520 granted to Rastall on May 23, 1995; 4,132,080 granted to Hansen on Jun. 2, 1979; 4,303,354 granted McWolell, Jr. on Dec. 1, 1981; 3,940,941 granted to Libert et al. on Mar. 2, 1976; and 3,877,235 granted Hill on Apr. 15, 1975.

Additional mine roof bolt systems are described in U.S. Pat. Nos. 4,607,984 granted to Cassidy on Aug. 26, 1986 and 4,275,975 granted to Morgan on Jun. 30, 1981.

The mine roof bolt systems and their associated nuts used to apply a controlled torque to the bolt elements have various disadvantages, including frangible portions as noted previously, non-uniform torque transmitting characteristics, stress concentrations localized along the nut or bolt threads and relatively high costs of production.

BRIEF SUMMARY OF THE INVENTION

The present invention overcomes the disadvantages noted in the prior art systems and provides a torque nut useable in a mine roof bolt assembly intended for use with a multi-component, mixed in situ, rapid curing resin system requiring rotation of the bolt through the mine roof bolt nut element to cause mixing of the resin before the nut is fully advanced along the threads of the bolt to set the nut against a mine roof with the bolt in tension.

The torque nut incorporating the present invention comprises a nut body having opposed ends and including a threaded bore having a uniform inner diameter defined by the peaks or inner diameter of the threads of the bore extending longitudinally through the nut body between its ends. The threads of the nut bore have a uniform lead or pitch extending over one portion of the bore adjacent one end of the nut and a progressively decreasing lead or pitch over a second portion of the bore, the second portion approaching the end of the nut opposed from the first end thereof.

The progressively decreasing lead of the nut threads is arranged such that the threads at the opposed end of the nut have a minimum lead adjacent such end and the leads of the threads progressively increase until, at some point within the bore, the thread lead corresponds to the uniform standard thread lead that extends from the one end of the bore. The nut, when rotated on a bolt, advances in the direction of the end having the uniform lead threads.

The progressively varied thread leads are created by a coining process whereby the end of the nut facing away from the advancing direction of the nut on a mine roof bolt is locally coined adjacent the nut bore to cause slight compression of the thread leads adjacent the coined end of the bore along a length of the bore and in the absence of any substantial radial deformation of the threads or alteration of the thread cross-sectional geometries. This coining procedure is carried out using a pilot pin or shaft in the bore of the nut that maintains a uniform inner diameter of the nut bore while compressing the thread leads axially along a desired length of the nut bore.

The progressively varying thread leads cause an interference between the uniform bolt threads and the nut threads as the nut is threaded along the bolt in an advancing direction. The uniform threads of the bolt first encounter nut threads having a minimum lead change from the uniform lead of the nut threads and progressively encounters threads having a decreasing lead until, after advancement of the bolt threads into the decreasing lead nut threads over a predetermined rotational angle, the interference between the nut threads and the bolt threads enables transmittal of a predetermined torque into the bolt through the nut as the resistance to relative rotation between the nut and bolt reaches a design limit.

Continued rotation of the nut transmits torque into the bolt to enable mixing of a mine bolt resin system in the mine roof bore hole until, after the resin has hardened, continued rotation of the nut can be carried out by overcoming the force created by the interference between the progressively varied thread leads of the nut and the uniform thread leads of the bolt.

Because the torque transmitting characteristics between the nut having a varied thread lead and the bolt can be carefully controlled by the coining process, uniformity of torque loads between identical torque nuts is assured and the torque nut system avoids broken pieces and bent elements that protrude from the nut during or following installation of the nut on a mine roof bolt.

A more detailed description of the invention follows below, which should be considered in view of the appended drawings of the invention.

BRIEF DESCRIPTION OF THE DRAWINGS

With reference to the appended drawings:

FIG. 4 is a vertical perspective view of a torque nut constructed in accordance with the invention;

FIG. 5 is a detailed view corresponding to the detail shown at V in FIG. 4; and FIG. 6 schematically illustrates a coining procedure used in accordance with the invention.

DETAILED DESCRIPTION OF A PREFERRED EMBODIMENT OF THE INVENTION

Figure 1:
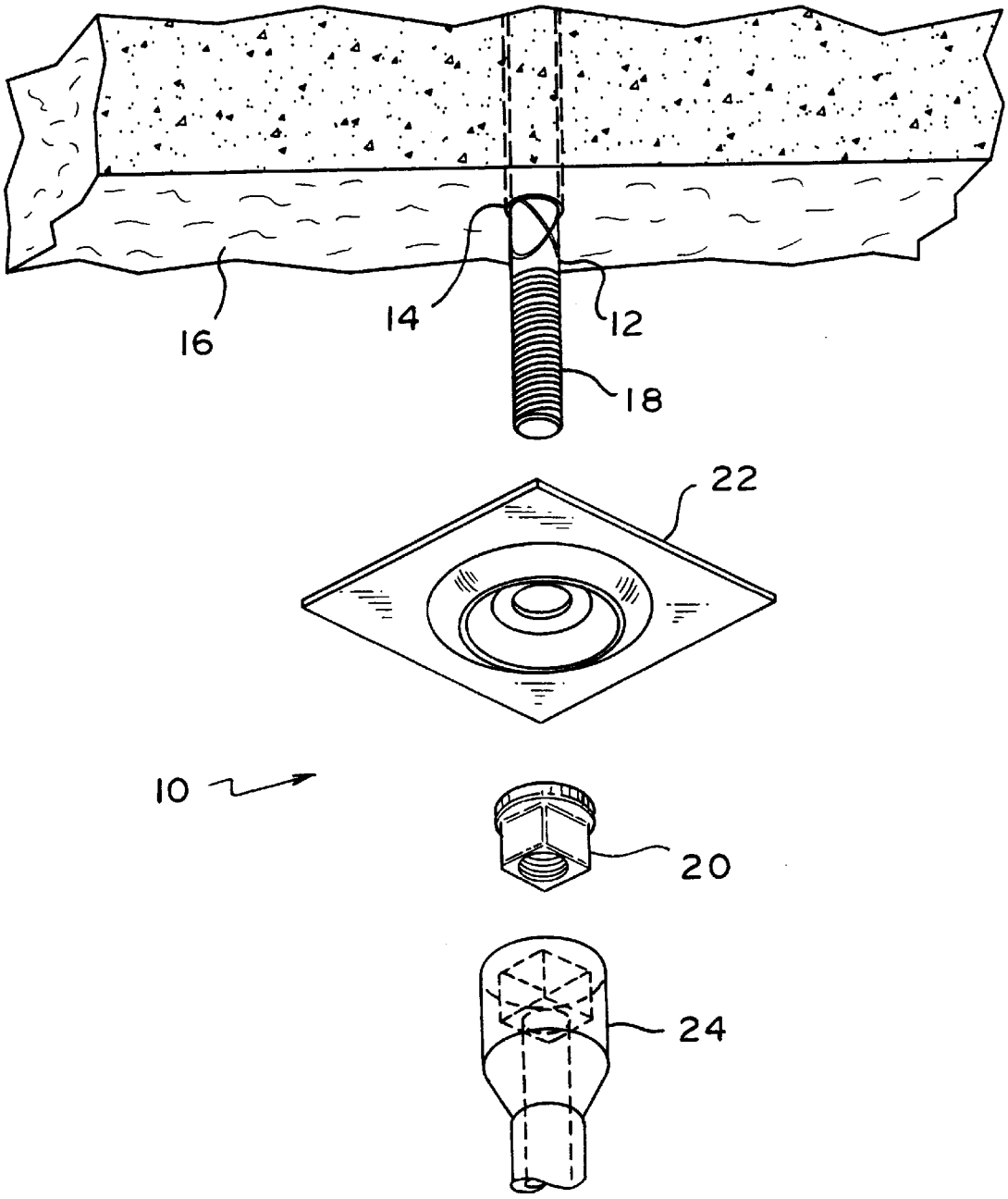
FIG. 1 schematically illustrates a mine roof bolt assembly including a threaded tension rod and a torque nut constructed in accordance with the invention.

With reference to FIG. 1, a mine roof bolt assembly 10 includes a conventional mine roof bolt 12 that comprises an elongated tension rod that has been inserted in a hole 14 bored in a rock and sediment layer 16 defining a mine roof. The bolt 12 comprises, for example, a conventional rebar (reinforcement rod) made of steel having a pattern of ridges extending along its outer periphery, as illustrated, and having an exposed threaded end 18, the threads of which are uniform, standard and intended to mate with the threads of a threaded nut 20 that will be threaded on the end 18 to apply thrust against a pressure plate 22 that will be urged against the mine roof 16 by advancement of the nut 20 on the threads 18, all of which is conventional. Nut 20 is advanced along the threads 18 by rotation of a tool 24 termed a "pinner" in the mine industry. The tool 24 is connected to mechanized mining equipment that inserts the bolt 12 into the hole 14 then, after the nut is manually placed on the bolt 12, advances the nut 20 along the threaded end 18 by rotating the tool 24 by a power supply until an appropriate loading of the bolt 12 is achieved as evidenced by application of a predetermined torque setting to the nut 20 when resistance to rotation of the nut reaches a predetermined level.

Figure 2:
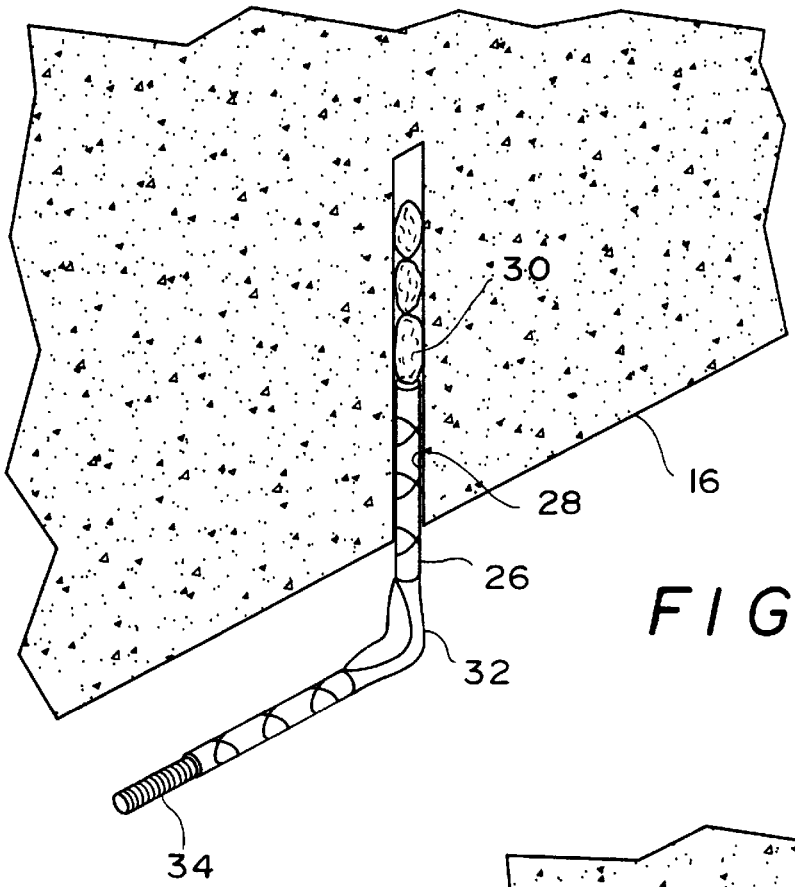
FIGS. 2 and 3 illustrate a procedure for installing elongated mine roof bolts involving bending of the bolt during the installation procedure.
Figure 3:
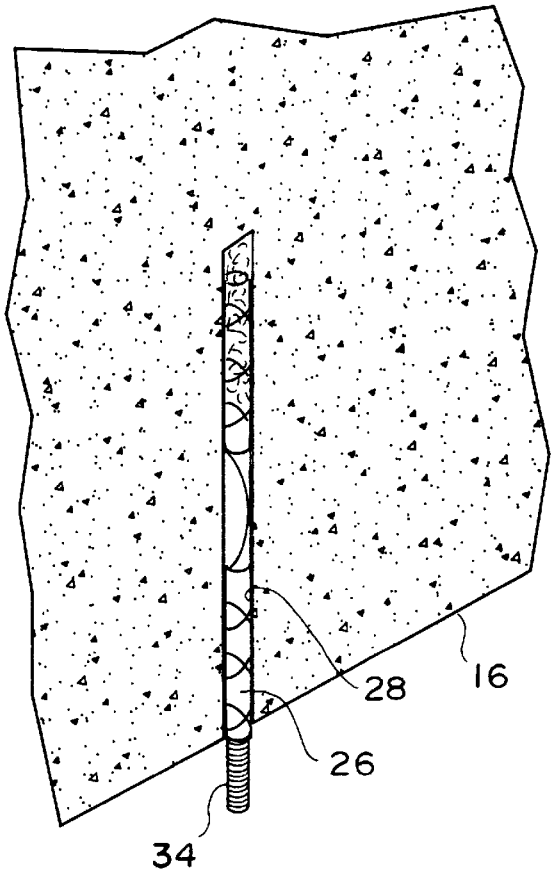

With reference to FIGS. 2 and 3, the mine roof bolt 12 in accordance with this invention is intended to be used with a mine bolt resin system that has been previously inserted in the bore 14 in frangible cartridges or capsules before insertion of the bolt 12 in the hole and which comprise multi-component, cured in situ, rapid curing resin that is known in the field of mining and rock bolts. Such multi-component resins, as just mentioned, are usually packaged in cartridges that include both the resin compound and the accelerator or curing compound within the cartridge. A sufficient number of cartridges is inserted into the bore hole that receives the bolt, so that, upon insertion of the bolt in the bore hole, the cartridges are ruptured by advancement of the bolt in the bore hole to initiate the resin curing process. However, it is necessary to mix the resin and curing materials together uniformly as quickly as possible upon insertion of the bolt in the bore hole and the mine roof and rock bolt industry has developed and uses recognized equipment to insert the mine roof bolt into the bore hole to cause rupturing of the resin cartridges and to thereafter rotate the mine roof bolt to cause uniform mixing of the resin components together while the resin cures. Typically, rotation of the mine roof bolt is suspended after mixing while the resin sets up, usually within a matter of one half minute or less, and thereafter the nut used with the bolt is advanced in a manner described above while the bolt is restrained from rotation by the cured resin disposed between the mine roof bolt and the adjacent mine roof material defining the inner diameter of the bore hole in the mine roof.

FIG. 2 illustrates how an elongated mine roof bolt 26 may be inserted in a bore hole 28 previously drilled in the rock formation defining the mine roof in which the bolt 26 is inserted when there is insufficient head room. Cartridges of multi-component, component, cured in situ, rapid curing mine bolt resin 30 have been previously placed in the bore hole 28, as shown. The bolt 26 has been bent at some point along its length at a deformed portion 32 that is designed to facilitate bending of the bolt at that prescribed location. This technique is used where the roof clearance of the mine is insufficient to enable insertion of the bolt 26 longitudinally along its length without bending. Upon insertion of one end section of the bolt 26 as illustrated in FIG. 2, the remaining portion on the opposed side of the deformed portion 32 can be aligned with the portion of the bolt already inserted in the mine roof bolt so that the entire bolt 26 may be advanced into the bore hole to cause rupturing of the cartridges 30 and rough mixing of the components of the resin in the bore hole. Typically, the resin mixture will extend along a substantial distance along the bore hole between the mine roof bolt and the adjacent rock and sediment in which the bore hole is formed. This establishes a strong connection between the mine roof bolt 26 and the adjacent material in which the bore hole 30 has been drilled.

FIG. 3 shows the bolt 26 installed in the bore hole 28 with the cartridges ruptured and the resin in the cartridges roughly mixed and disposed between the bolt 26 and the bore hole 28 along the major portion of the bore hole 28, and with the threads 34 of the bolt 26 exposed to enable threading thereon of a nut in the manner to be described below. As noted previously, the next step in the installation procedure is to thread a nut onto the threads 34 of the bolt 26 by means of a pinner tool, usually with a pressure plate 22 or the like located between the nut and the mine roof 16.

In accordance with the prior art, various types of nut elements have been utilized that permit application of a predetermined torque to the bolt 26 that permits transmittal of torque between the pinner 24 and the bolt 26 through the nut element to effect uniform mixing of the resin used to anchor the mine bolt in the rock bore hole. Upon setting up and hardening of the resin, the nut element is torqued in excess of the predetermined torque, resulting in advancement of the nut along the threads 34 to produce a desired axial tension in the bolt 26 upon the nut being advanced a sufficient amount to meet a predetermined specification defined as a torque setting of the nut on the bolt. Thus, after hardening of the resin, the bolt 26 resists rotation in the bore hole so that the nut which previously was used to rotate the bolt can be advanced up to the final torque setting to complete the installation of the mine roof bolt assembly.

A torque nut to be used with a mine roof bolt assembly in accordance with the present invention will now be discussed with references to FIGS. 4–6. It is to be understood that the term "mine roof bolt" extends not only to roof bolts but also to rock bolts generally, whether used in a mine roof or elsewhere. Also, the mine roof bolt assembly intended to be used with the inventive torque nut made in accordance with this invention may be a bolt that is bent during installation, as shown in FIGS. 2 and 3, or a bolt that is inserted in its respective bore hole longitudinally without bending.

In accordance with the invention, a torque the corresponding in function to the nut 20 illustrated in FIG. 1 includes internal threads that will enable initial threading of the nut onto the threads 18 of the bolt 12 and then resist further advancement until a predetermined torque is exerted on the nut, the predetermined torque being sufficient to mix the resin and to overcome any resistance to rotation that may be caused by a bent rod rubbing against the bore hole wall. This predetermined torque is established by creating an interference between the threads of the mine roof bolt and the threads of the nut after the nut has been initially advanced along the threads of the bolt.

This interference between the bolt and nut threads, in accordance with this invention, is achieved by a nut 34 as shown in FIGS. 4–6 that includes a nut body 36 having flats 38 for engaging a pinner tool (or wrench, if the nut is to be advanced manually) and an integral, enlarged flange 40 at the end of the nut 34 facing the advancing direction of the nut 34 relative to a cooperating, threaded mine roof bolt. As illustrated in FIG. 4, the advancing direction of the nut 34 is upwardly.

The nut 34 includes a threaded bore 42 which includes standard threads 44 having a uniform lead at the end of the nut body 36 corresponding to the leading end as the nut is advanced along a mine roof bolt and a progressively decreasing lead as the threads approach the opposite end of the nut body 36 (the lower end as illustrated in FIG. 4). Preferably, the leads of the threads, as illustrated in FIG. 5, progressively decrease from a uniform lead at some point along the bore to a minimum lead at the end of the nut opposite the advancing end thereof.

As illustrated in FIG. 5, the last five leads of the threads 44 are designated $L_1$–$L_5$, with $L_5$ corresponding to the uniform thread leads of threads 44 and leads $L_4$–$L_1$ progressively decreasing until the last thread lead $L_1$ is reached.

The threads having uniform leads will mate and cooperate with the threads of a mine roof bolt without interference, but the threads 44 having progressively decreasing leads $L_4$–$L_1$ will progressively interfere with the passage of the bolt threads through the bore 42, which results in resistance being exerted against relative rotation between the nut 34 and a mating mine roof bolt until a predetermined torque is applied to the nut 34 to overcome the resistance to such relative rotation created by the thread interference.

The thread interference thus allows transmittal of torque energy from a tool such as pinner 24 without advancement of the nut relative to the bolt to thus permit transfer of torque energy into the resin mixture in the bore hole as previously explained. However, upon setting up and hardening of the resin, torque in excess of the predetermined torque can be applied to the nut 34 to overcome the resistance between the threads of the mine roof bolt and the threads of decreasing lead of the nut to thereby enable relative rotation between the nut and the bolt and advancement of the nut along the bolt until the nut reaches the mine roof, whereat further rotation of the nut produces axial tension in the mine roof bolt to a sufficient extent to set the mine roof bolt assembly at a proper tension loading.

It will be readily appreciated that it is highly desirable and advantageous to establish the predetermined torque that can be reacted through the nut into the bolt to effect mixing of the resin compound in the mine roof bore hole, as previously explained. It has been observed that, when bent mine roof bolt installations are used, the bent portion of the mine roof bolt creates drag in the bore hole that must be overcome by the application of torque to the torque nut to effect mixing of the resin but, upon setting and hardening of the resin, the nut must be relatively rotatable on the bolt threads to permit advancement of the nut along the threads. Very carefully controlled torque limitations are thus highly desirable to permit precisely predictable transmitting torques between a nut and a mine roof bolt for mixing the resin and later advancement of the nut along the bolt. The mating engagement of the bolt and nut threads must be such that the structural integrity of the nut and bolt assembly is maintained.

In accordance with the present invention, this control over torque transmission and strength of the assembly is achieved by varying the leads of the nut threads progressively along the nut bore between some point along the bore removed from the advancing end of the nut and progressing through the nut to the end opposite the advancing end. The variation in thread lead is calculated precisely to effect a predetermined interference between the mine bolt threads and the nut threads to achieve the desired torque reaction between a nut and the mine roof bolt when the nut is advanced along the bolt. This variation in thread lead of the nut threads is achieved without varying the inner diameter of the bore 42, which is maintained at a uniform desired inner diameter, as defined by the inner diameter of the threads 44.

This progressive variation of the thread leads as depicted by the designations $L_1$–$L_5$ in FIG. 5, is achieved by a coining process that compresses the end of a threaded nut 34 opposite the advancing end of the nut in a manner depicted in FIG. 6.

As shown in FIG. 6, a coining tool 46 includes a pilot section 48 having an outer diameter corresponding to the inner diameter of the threaded bore 42 and a body portion 50 terminating at a coining protrusion 52 that is configured to engage the area of the nut 34 immediately adjacent the bore 42 at the end of the nut opposite the advancing direction thereof.

To achieve thread lead variations $L_1$–$L_5$ described previously (actually $L_1$–$L_4$ because $L_5$ is a uniform lead), the coining tool 46 is advanced relative to the threaded nut 34 so that the pilot 48 enters the bore 44 and the coining protrusion 52 locally compresses and cold works the metal of the nut 34 immediately surrounding the end thereof opposite the end of advancement of the nut relative to a mine roof bolt. This cold working is termed "coining" in the field of metal working and is a well-known procedure used to compress metal work pieces by application of a concentrated force over a limited area of the work piece to thereby cause localized permanent compression of the work piece. It will be readily observable that upon coining of the nut 34 adjacent the end thereof facing the coining tool 46, the leads of the threads 44 already present in the bore will be forced closer together immediately adjacent the coining protrusion 52, with leaving a progressively increasing lead distance between threads at a progressively greater distance away from the coining protrusion 52. When thus subjected to the coining process, the threads 44 adjacent the coined end of the nut 34 will be displaced slightly in a progressive manner with the greatest displacement occurring immediately adjacent the coined end of the nut and with a lesser compression and displacement of the leads of the threads as the distance increases away from the coined end of the nut. However, the actual cross-section of each thread 44 is not substantially affected by the coining process and the pilot 48 prevents any substantial radial distortion of the nut threads 44 so that, as a net result, the profiles of the threads 44 are substantially unchanged while the leads $L_1$–$L_4$ of the threads are compressed so that they progressively decrease as the coined end of the nut is approached from the uniform lead threads.

In accordance with one example of a torque nut 34, the lead $L_5$ may be the uniform lead of the threads 44 and the progressively decreasing leads $L_4$–$L_1$ would be related to $L_5$ as follows:

$L_5$–0.100 in. (0.254 cm)

$L_4$–0.099 in. (0.251 cm)

$L_3$–0.0985 in. (0.250 cm)

$L_2$–0.0984 in. (0.250 cm)

$L_1$–0.080 in. (0.203 cm)

In the example described above, the coining depth (FIG. 5) corresponding to the distance the coined end of the nut 34 has been compressed is 0.020 in. (0.051 cm). The material of the nut in the example is a malleable alloy iron and standard threads having uniform leads of 0.100 in (0.254 cm) are machined into the bore 42 of the nut. The nut had a bore nominal inside diameter of 0.656 in (1.67 cm) and a length of 1.25 in (3.175 cm). After formation of the threads of uniform lead in the bore of the nut, the coining procedure previously described is carried out to achieve the thread lead variation in preferably a plurality of threads adjacent the coined end of the nut.

An example of a torque nut appearing like FIG. 4 that has been successfully tested was made from ASTM A220 grade 50005 pearlitic iron, 185–205 BHN (Brinell hardness), with an alloy content of 0.95–1.15 Mn, tempered at 1275° F. for five hours, so as to be readily machineable. The nut had a bore inside diameter of 0.656 in. (1.67 cm) and a length of 1.25 in. (3.175 cm). One end of the nut opposite the flange was coined using a force of 23 tons to produce the progressively decreasing thread leads previously described that produced an interference between the mine roof bolt threads, which were ¾–10 NC, and the nut threads that resulted in a torque transmittal capacity of 120 foot-pounds between the nut and the bolt. When the nut and bolt assembly was tension loaded and tested, the yield strength of the assembly was 34,000–35,000 psi, and the tensile ultimate strength was 45,500–46,250 psi. No damage was sustained to the nut or its threads during the test to failure. During the tensile test, the tensile force was between the nut and bolt, with the bolt failing before the nut.

It will thus be observed that by the seemingly simple expedient of varying the nut thread leads by coining the end of the nut opposite the advancing end thereof, a suitable interference connection between the nut threads and the bolt threads of a mine bolt assembly can be achieved to thereby provide transmittal of a highly controllable torque load through the nut into the bolt to permit use of the nut to rotate the bolt during mixing of a resin in a mine roof bore hole and thereafter advancement of the nut along the bolt after the resin has hardened without loosening the bolt in the resin matrix to set the nut (and a pressure plate or fixture) against the mine roof at a predetermined torque setting that is representative of an axial load or tension on the mine roof bolt. Also, the aforesaid advantages are obtained while preserving the full strength of the nut and bolt assembly.

Variations of the shape and form of the inventive nut and the nut threads fall within the scope of the invention and the specific contour and shape of the nut itself can be varied in accordance with known principles without departing from the inventive concept. The specific materials utilized for the mine roof bolt and the torque nut may be selected from those materials meeting applicable specifications existing in the industry without departing from the scope of the invention.

Preferably a plurality of threads will be included in the threads having the progressively decreasing leads and a number of threads having uniform leads will also be provided in the torque nut made in accordance with the invention. By progressively varying the thread leads, the uniform leads on the mine roof bolt can be advanced until at least a full 360° circumferential length of mine roof bolt thread will be engaged with a thread lead that is less than the uniform lead so that the torque load transmitted through the nut will be uniformly dispersed around the periphery of the thread to avoid stress concentrations in localized areas of those threads having a decreasing lead that are next adjacent the threads of uniform lead within the nut bore. This provides an added advantage resulting from the invention, namely the avoidance of stress concentrations where the threads interfere with each other.

There follows a description of various tests that were conducted by the inventor to determine appropriate nut materials that would respond to coining techniques to vary the thread leads of the torque nut.

An ASTM 65-45-12 ductile alloy iron nut meeting all ASTM standards for roof and rock bolt assembly specifications did not produce satisfactory torque nuts because the torque transmission through the nut varied with the same coining depth on each nut.

An ASTM A220, grade 32510, 100% ferritic iron, 110–150 BHN (Brinell hardness), alloy content of 0.35–0.45 Mn., full ferritizing anneal, was found to be too soft to transmit adequate torque after coining.

An ASTM A220, grade 45006, pearlitic structure iron, 130 –170 BHN, alloy content 0.95–1.15 Mn., with full ferritizing anneal resulted in threads that were too brittle and which sheared out after coining and application of torque corresponding to an acceptable level.

An ASTM A220, grade 45006, pearlitic structure iron, 136–175 BHN, alloy content 0.35–0.45 Mn., tempered at 1250° F. for five hours, resulted in a nut material that was acceptable but which exhibited slight galling on the last two threads of the coined area. The material was readily machineable and the nut was coined at a force of 16 tons. Rotational torque transmitted was 105 foot-pounds. When subjected to a tensile test with a grade 60, ¾–10 NC threaded mine roof bolt, the yield strength was 34,000 psi and the ultimate strength was 46,250–45,500 psi, with no damage exhibited by the nut or its threads (the bolt yielded and fractured).

An ASTM A220, grade 45006, pearlitic structure iron, 130 –170 BHN, alloy content 0.35–0.45 Mn., tempered at 1275° F. for five hours, resulted in a nut that exhibited good machinability. When subjected to a coinage of 16 tons, the nut was capable of transmitting a torque of 100 foot-pounds. A tensile test on the nut and bolt assembly, using a grade 60 bolt, ¾–10 NC threads, exhibited a yield strength of 33,750–34,500 psi and a tensile strength of 46,000 psi, with no damage exhibited by the nut or its threads.

An ASTM A220, grade 50005, pearlitic structure iron, having a 195–225 BHN, an alloy content of 0.95–1.15 Mn., was noticeably less machineable than the other nuts tested but which nevertheless was machineable using high speed tool steel. A coining force of 22 tons applied to the nut resulted in variation of the nut thread leads that produced an interference with the bolt threads resulting in transmittal of torque of 95 foot-pounds. Yield strength of the nut and bolt assembly under tensile test was 33,750–34,500 psi, with a tensile strength of 45,000–46,500 psi, without damage to the nut or its threads.

An ASTM A220, grade 50005, pearlitic structure iron, with 185–205 BHN, an alloy content of 0.95–1.15 Mn, tempered at 1275° F. for five hours, was readily machineable and, upon coining under a load of 23 tons, the nut was capable of transmitting a torque of 120 foot-pounds on the bolt. When subjected to a tensile test with a grade 60, ¾–10 NC threaded bolt, the yield strength of the assembly was 34,000–35,000 psi and the tensile strength was 45,500–46,250 psi, with no damage to the nut or its threads.

The aforementioned manufacturing and test procedures are described herein in compliance with applicable patent disclosure laws, including laws specifying that the best mode for carrying out the invention must be contained in the written description of a patent application. Neither the exemplary embodiments of the invention described previously nor the examples described above are intended to limit the scope of the invention, which is entitled to the full scope of protection provided by the scope and content of the appended claims.

I claim:

1. A torque nut for a mine roof bolt, comprising:

a metallic nut body having opposed ends and including a threaded bore having a uniform inner diameter defined by the inner diameter of the threads of the bore extending longitudinally through the body between said ends; and the threads of said bore being continuous and having a uniform lead extending over one portion of the bore adjacent one end of the nut and a progressively decreasing lead over a second portion of the bore approaching the opposed end of the nut from the first end thereof, said progressively decreasing lead having a minimum lead adjacent said opposed end.

2. The torque nut as claimed in claim 1, said nut body including an integral enlarged flange portion adjacent the one end of the nut body whereat the threads of uniform lead are located.

3. The torque nut according to claim 1, wherein the portion of said bore threads having a decreasing lead extends over a plurality of threads along the bore.

4. The torque nut according to claim 1, wherein said one end of said nut body faces the advancing direction of the nut when the nut engages and rotates on a mating threaded bolt in a tightening direction.

5. The torque nut according to claim 1, wherein said progressively decreasing lead of said bore threads comprise uniform threads that have been compressed by coining the said opposed end of the nut body in the nut body area adjacent the bore in the direction of the one end of the nut body while maintaining the inner bore diameter.

6. A mine roof bolt assembly, for use with a mine bolt resin, comprising:

an elongated metallic tension rod having a threaded outer end that is exposed when the bolt is normally installed in a mine roof bore hole, the bolt threads at said outer end having a uniform lead, and an inner end extending to cooperate with a multi-component, mixed in situ, rapid curing mine bolt resin disposed in the mine roof bore hole;

a metallic torque nut having opposed ends and including a threaded bore having a uniform inner diameter defined by the inner diameter of the bore threads extending longitudinally through the bore between said ends;

the threads of said bore being continuous and having uniform leads extending over one portion of the bore adjacent one end of the nut body and a progressively decreasing lead extending over a second portion of the bore approaching the opposed end of the nut body from the said one end thereof, said progressively decreasing lead having a minimum lead adjacent said opposed end;

said bore threads of uniform leads mating without interference with said bolt threads over said first portion of said bore when said nut is threaded on the bolt and advanced in a tightening direction by rotation of the nut, said bore threads of decreasing lead producing progressive interference with the passage of the bolt threads through the nut bore upon advancement of said bore threads on said bolt threads; and said progressive interference between the decreasing lead bore threads and the uniform bolt threads resulting in application of a predetermined torque to said bolt upon rotation of said nut relative to said bolt in an advancing direction, and said interference not exceeding an amount preventing complete threading of said bore threads on said bolt threads once the predetermined torque is exceeded.

7. The mine roof bolt assembly according to claim 6, wherein the portion of said bore threads having a decreasing lead extends over a plurality of threads along the bore.

8. A mine bolt assembly according to claim 6, said tension rod being formed of steel and said nut body comprising an alloy cast iron and wherein said progressively decreasing lead of said bore threads comprise uniform lead threads that have been compressed by coining the opposed end of the nut body adjacent the bore in the direction of the one end thereof while maintaining the inner bore diameter.

9. A method of producing a metallic torque nut for use with a mine roof bolt system wherein a predetermined torque is to be transmitted by the torque nut to an associated mine roof bolt before the nut is fully advanced onto the bolt, the nut and bolt being mated together by nut and bolt threads, respectively, comprising the steps of:

forming a threaded nut with uniform standard lead threads along a bore extending through the nut; and coining one end area of the nut adjacent the bore to locally compress and permanently deform the nut material subjected to the coining force and to cause progressive change in the thread leads from the coined end of the nut to an area in the bore of the nut between the ends of the bore, and in the absence of any substantial radial or profile variation of the nut threads.

10. The method according to claim 9, including the steps of:

carrying out the coining so that an interference will be created between the nut and bolt threads that will not permit full advancement of the nut and threads along the bolt threads until a predetermined torque is exceeded, said predetermined torque not exceeding an amount preventing complete threading of said bore threads on said bolt threads once the predetermined torque is exceeded.

11. The method according to claim 10, wherein the coining is carried out such that said predetermined torque will not be reached until a uniform thread of the bolt is substantially fully engaged with a nut thread having a diminished lead.

12. A torque nut made by the method according to claim 9.

* * * * *